United States Patent [19]

Shelton

[11] Patent Number: 4,732,547

[45] Date of Patent: Mar. 22, 1988

[54] APPARATUS FOR IMPELLING LIQUID

[76] Inventor: Peter A. Shelton, Es Moli Nou De Canet, Es Glayete, Majorca, Spain

[21] Appl. No.: 815,094

[22] PCT Filed: Mar. 29, 1985

[86] PCT No.: PCT/GB85/00128

§ 371 Date: Nov. 27, 1985

§ 102(e) Date: Nov. 27, 1985

[87] PCT Pub. No.: WO85/04453

PCT Pub. Date: Oct. 10, 1985

[30] Foreign Application Priority Data

Mar. 29, 1984 [GB] United Kingdom ..... 8408098

[51] Int. Cl.[4] ..... F04B 9/08; F04B 43/10

[52] U.S. Cl. ..... 417/379; 417/380; 417/394

[58] Field of Search ..... 417/391, 394, 364, 379, 417/380

[56] References Cited

U.S. PATENT DOCUMENTS

| | | | |
|---|---|---|---|
| 3,418,940 | 12/1968 | Martin | 417/394 |
| 4,427,350 | 1/1984 | O'Hare | 417/379 |
| 4,502,848 | 3/1985 | Robertson et al. | 417/380 |

FOREIGN PATENT DOCUMENTS

| | | | |
|---|---|---|---|
| 706728 | 11/1967 | Belgium . | |
| 2430450 | 1/1976 | Fed. Rep. of Germany . | |
| 2617026 | 10/1977 | Fed. Rep. of Germany . | |
| 2817918 | 11/1978 | Fed. Rep. of Germany | 417/394 |
| 1540830 | 9/1968 | France . | |

*Primary Examiner*—Carlton R. Croyle
*Assistant Examiner*—Theodore Olds
*Attorney, Agent, or Firm*—Flynn, Thiel, Boutell & Tanis

[57] ABSTRACT

A pump is disclosed in which high pressure air overcomes a valve spring and displaces a flexible partition to isolate a pump fluid volume. The pressure air then drives the fluid along a conduit.

11 Claims, 16 Drawing Figures

APPARATUS FOR IMPELLING LIQUID

This invention relates to apparatus for cyclically impelling liquid by means of a supply of gas under pressure for example in the form of compressed air, steam, exhaust gases from an internal combustion engine or combustion gases from a gas generator device.

According to the invention there is provided apparatus for impelling liquid comprising a duct for the liquid, a flexible partition extending from an anchored zone in the downstream direction of the duct, an opening in the wall of the duct for the supply of gas under pressure, the opening being adjacent, and on the downstream side of the anchored region of the partition, a valve member carried by, or formed by part of, the partition and resilient means urging the valve member to close the opening.

With this arrangement, when the gas pressure is sufficient to overcome the bias exerted by the resilient means and lift the valve member, gas is applied against one surface of the partition to deform the latter in a wave-like manner, the wave-like deformation travelling in the downstream direction and thereby causing the other surface of the partition to impel liquid along the duct.

Although the gas pressure at the opening will drop as the valve member moves against the resilient bias to uncover the opening, this reduced gas pressure acts over an area of the partition which is much greater than that of the valve member (i.e. than the area of the opening) and the valve will remain open until the motion of the liquid in the duct allows the gas to travel sufficiently far downstream along the partition to reduce the force exerted by it on the valve member to a value at which the resilient bias can move the valve member to reclose the opening.

Preferably, the partition is capable of deformation between a position in which it substantially conforms to the duct wall and covers the said opening while leaving the duct substantially unobstructed, and a position in which the opening is uncovered so that gas, having attained sufficient pressure to overcome the resilient bias, is directed downstream by the partition while the latter inflates across the duct.

Preferably, the duct is of substantially constant cross-section along its length, being advantageously of circular cross-section.

The anchored zone of the valve member advantageously extends around the full circumference of the duct and may conveniently be at the inlet of the duct. Preferably, the anchored zone of the valve member is oblique with its portion adjacent the opening being furthest upstream.

Preferably, an open work support structure such as a grid is mounted with its periphery adjacent the anchored zone of the partition to act as a support for the partition against deformation against a predetermined configuration under gas pressure.

The partition may extend for substantially the full length of the duct.

The invention will now be further described by way of example with reference to the accompanying drawings, in which.

Figure 1:
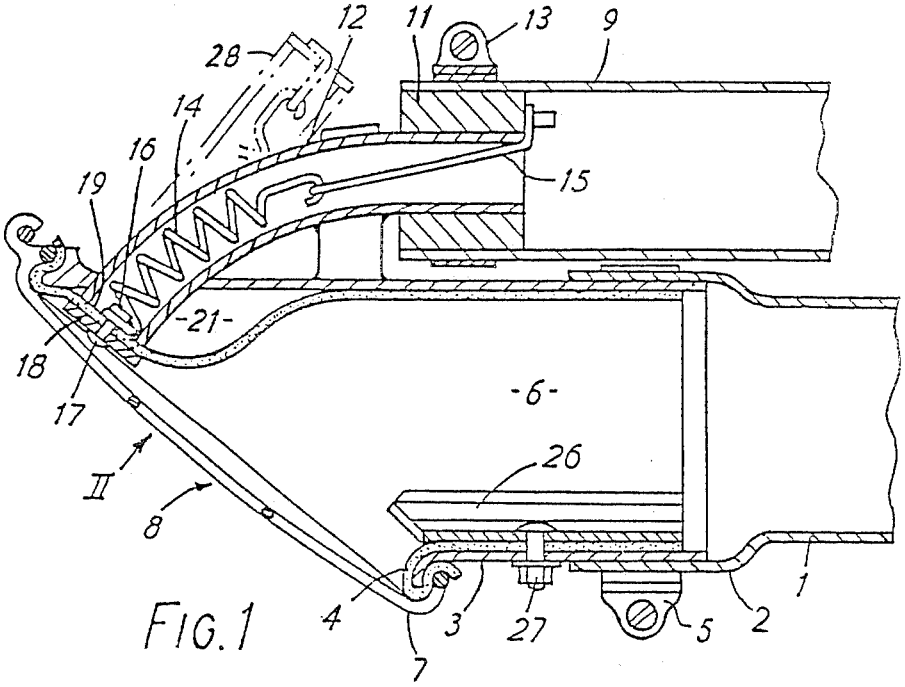
FIG. 1 is an axial sectional view of a pump in accordance with the invention.
Figure 2:
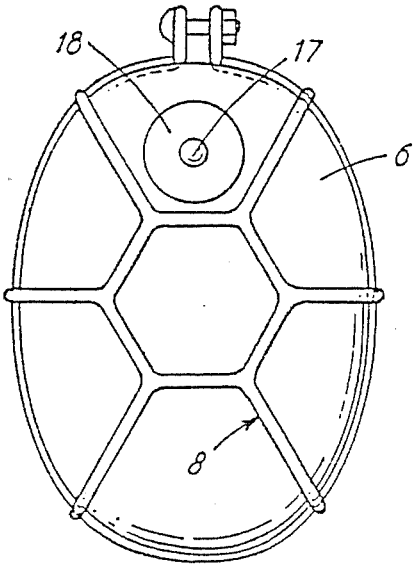
FIG. 2 is a view in the direction of the arrow II of FIG. 1.
Figure 3:
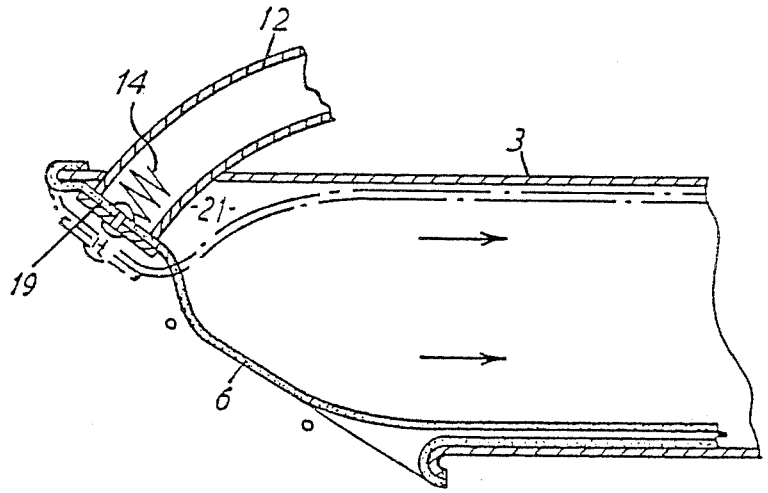
Figure 4:
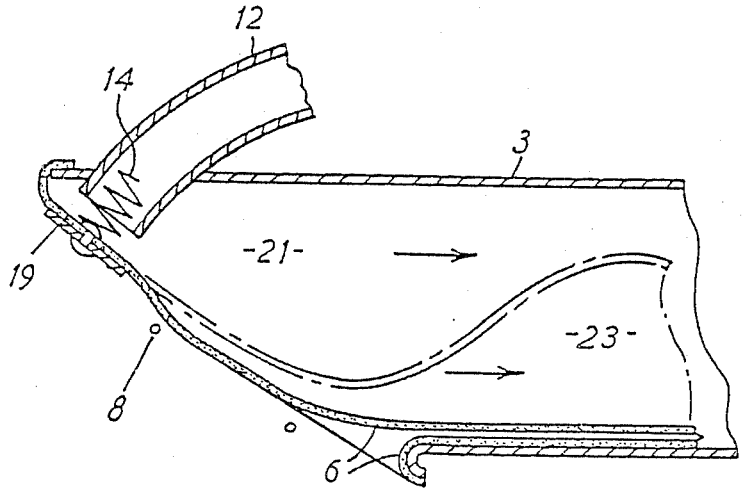

FIGS. 3 and 4 each show two stages in the operating cycle of the pump shown in FIG. 1.

Figure 5:
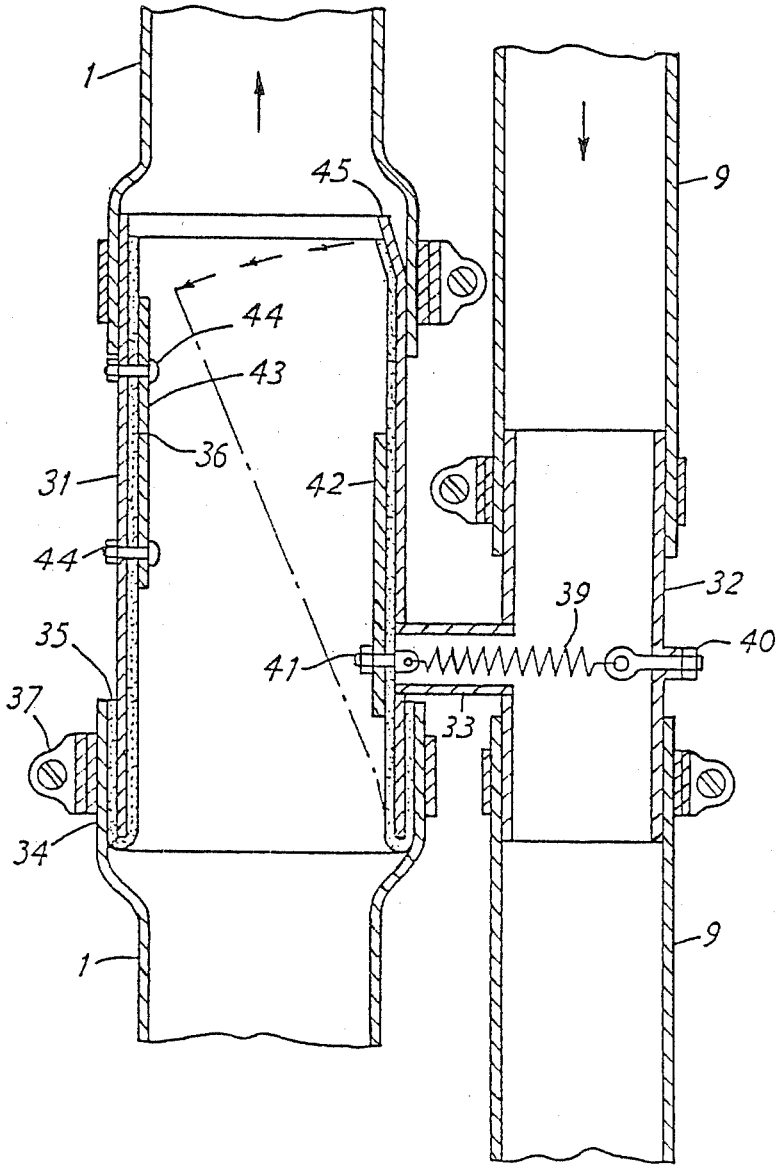

FIG. 5 is a longitudinal sectional view of a boooster device for use with the apparatus of FIGS. 1 to 4.

Figure 6:
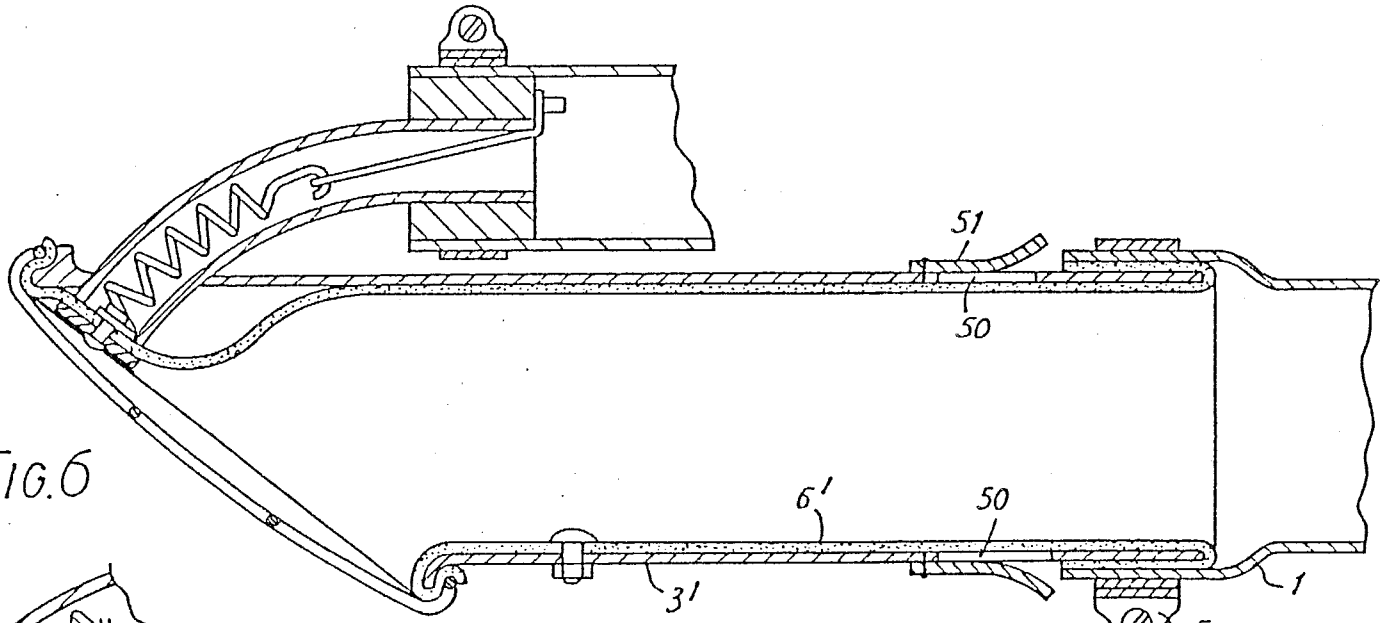
Figure 7:
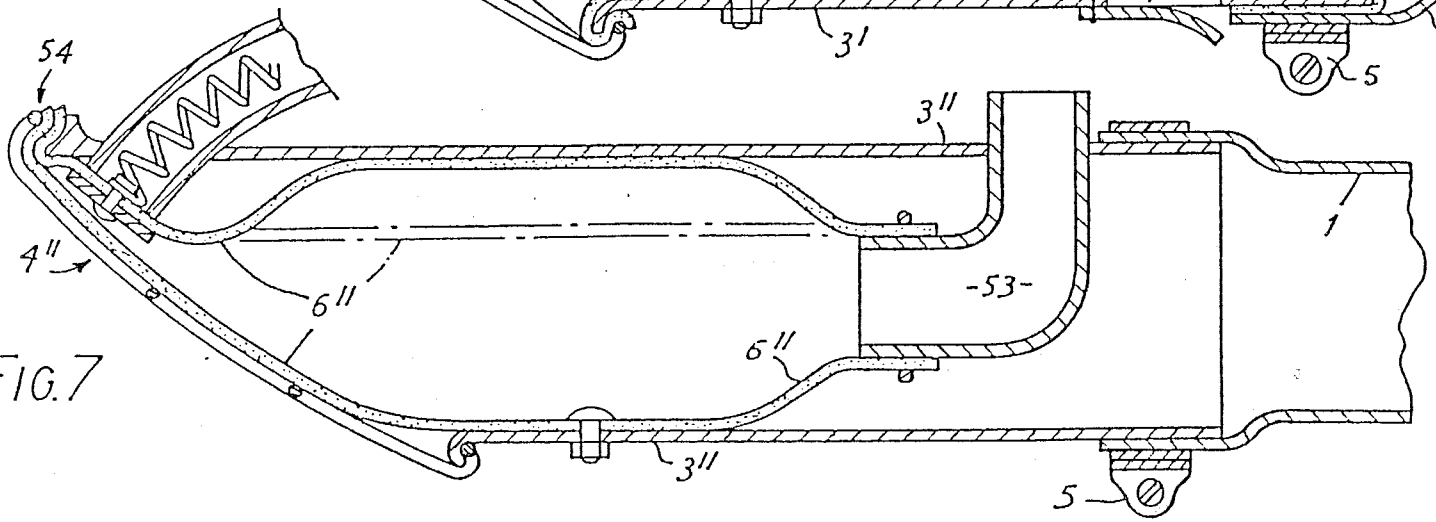
Figure 8:
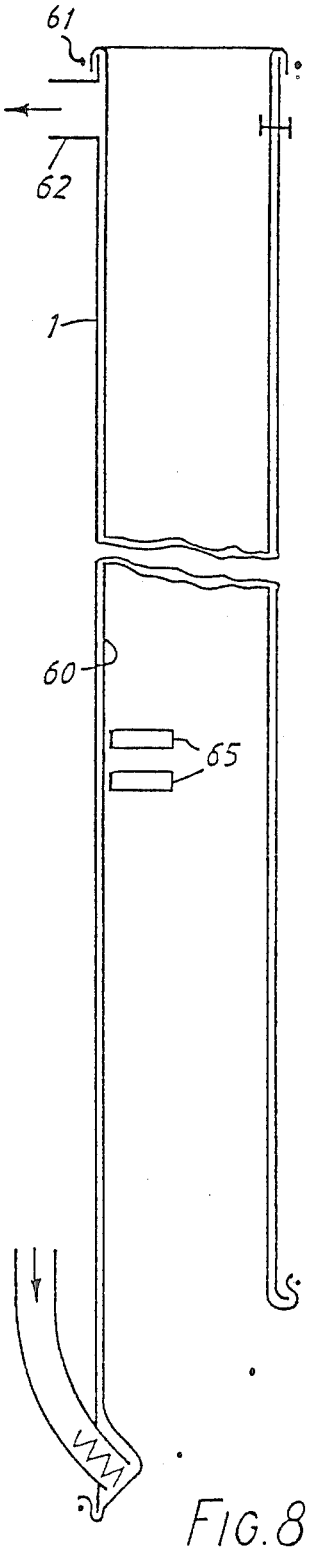

FIGS. 6, 7 and 8 are views similar to FIG. 1 of three forms of apparatus in which the gas is kept separate from the impeller liquid.

Figure 9:
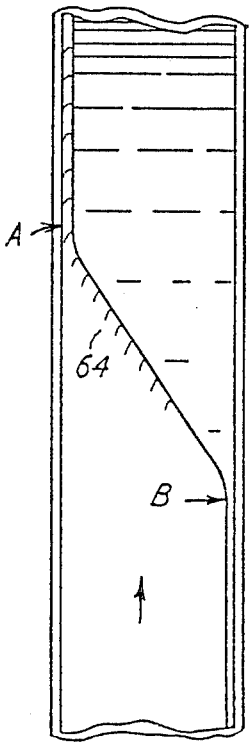

FIG. 9 shows a modification of part of FIG. 8 on an enlarged scale.

Figure 10:
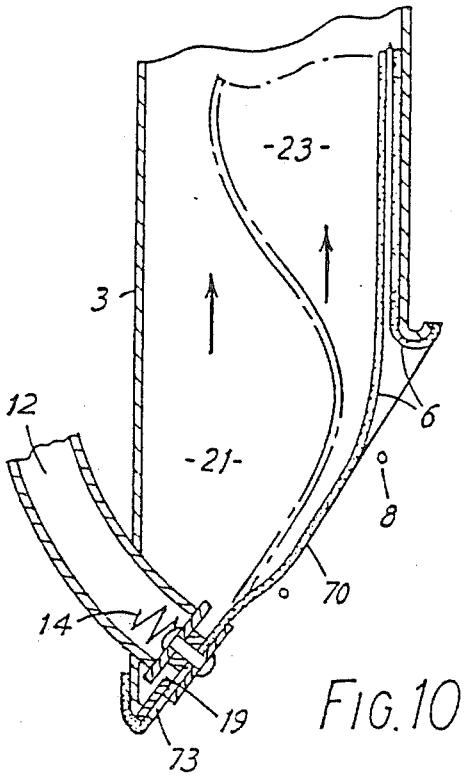

FIG. 10 shows a modification which can be made to any of FIGS. 1 to 8 for use with higher temperature gas.

Figure 11:
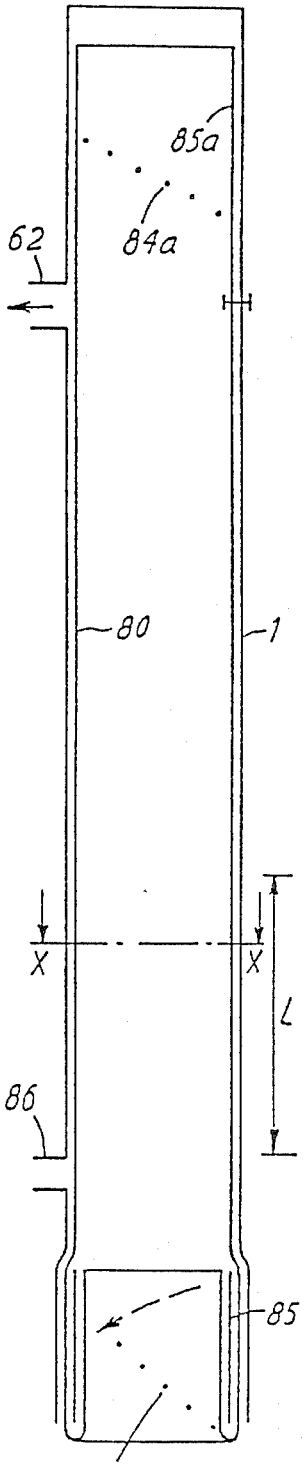

FIG. 11 shows a further embodiment in longitudinal section.

Figure 12:
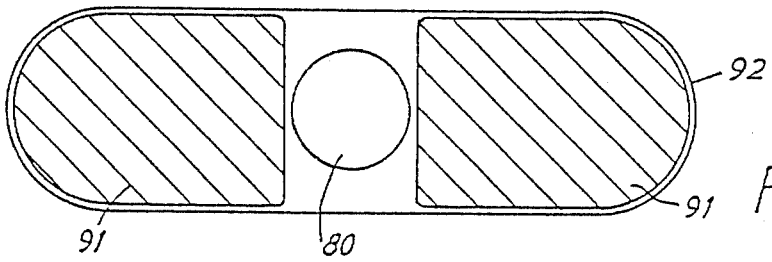
Figure 13:
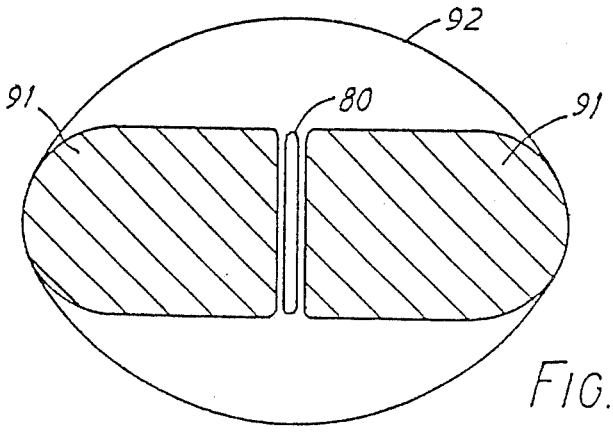

FIGS. 12 and 13 are cross section views of a modified form of FIG. 11 on the line X—X thereof.

Figure 14:
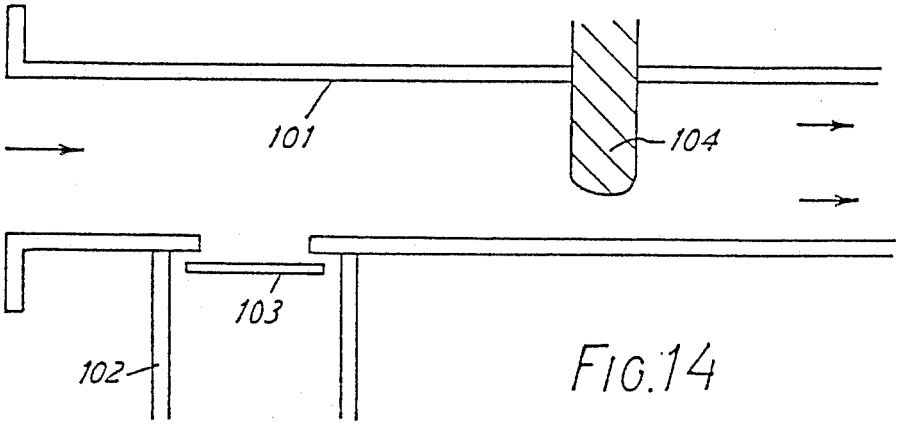
Figure 15:
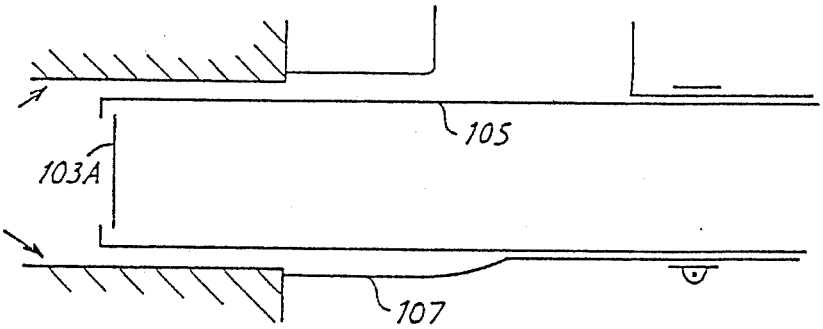

FIGS. 14 and 15 are diagrammatic section views showing two arrangements for taking exhaust gas from a four-stroke engine to power any of the pumps shown in FIGS. 1 to 13, and FIG. 16 shows a solar-powered air compressor in axial section.

The pump shown in FIG. 1 is constructed to impel liquid, such as water, along a duct in the form of a pipe 1 formed of polyethylene. The mouth 2 of the pipe is of slightly increased diameter to receive one end of a metal tube 3, the other end of which is cut at an angle to its axis to form an elliptical inlet 4. The tube 3 is secured in the end 2 of the pipe 1 by means of a hose clip 5. Around its oblique inlet 4, the margin of the tube 3 is rolled outward to form a smooth rounded seating for a correspondingly obliquely cut end of a rubber tube 6, the oblique end of the tube 6 being turned outwards around the end of the tube 3 and anchored by means of a clip 7. A wire grid 8 is brazed to the clip 7 and prevents outward movement of any of the rubber tube 6 much beyond the plane of the mouth 4 while offering minimal resistance to liquid flow.

A pressurized gas supply pipe 9 has one end (not shown) connected by means of a flexible tube to the exhaust pipe of an internal combustion engine, preferably a four-stroke diesel engine. The pipe 9 may also be of polyethylene. A bung 11 in the other end of the pipe 9 has a central bore which receives one end of a curved tube 12. The pipe 9 and bung 11 are clamped securely by a hose clip 13. Housed within the curved pipe 12 is a spring 14 one end of which is anchored by means of a rod 15 to bung 11. The rod 15 may be adjustable in length by means of a nut. The other end of the spring 14 is secured under a nut 16 on a bolt 17 which passes through a rigid disc 18, of larger diameter than the tube 12, and through the rubber tube 6.

In operation, the portion of the apparatus shown in FIG. 1 is immersed in the liquid to be pumped to impelled along the pipe 1. The rubber tube 6 and adjacent part at least of the pipe 1 fill with liquid. The spring 14 and disc 18 cause the gas valve portion of the rubber tube 6 which is in contact with the disc 18 to close the outlet end of the tube 12. Accordingly, when the pipe 9 is connected to a source of pressurised gas such as the exhaust pipe of a diesel engine, the pressure in the pipe 9 and tube 12 will rise until the pressure exerted on the gas valve portion 19 is sufficient to move the latter away from the end of the tube 12 against the action of the spring 14.

Pressurized gas then flows into the space 21 between the upper part of the tube 6 adjacent the inlet or mouth end thereof and the upper part of the tube 3. The tube 6 then progressively changes shape from the position shown in broken lines in FIG. 3 to that shown in broken lines in FIG. 4 and thereafter to that shown in full lines in FIG. 4 where the rubber tube 6 closes the inlet 4 of the pipe 3 against reverse flow. Although the gas pressure will fall, it will now be acting on an area of the rubber tube 6 which is much greater than the internal cross sectional area of the tube 12 and can therefore still hold the gas valve portion 19 in the open position. During this process, the liquid in the region 23 in FIG. 4 will be pushed or impelled in the downstream direction (to the right in FIG. 4). Finally, the fall in the pressure in the tube 12 and suction exerted by the momentum of the liquid within the tube 3 and pipe 1 will allow the spring 14 to cause the valve portion 19 to close against the end of the tube 12 to the position shown in full lines in FIG. 3. Thereafter, the momentum of the liquid within the tube 3 and pipe 1 will draw the rubber tube 6 back to the position shown in FIG. 1.

Throughout the sequence of operation described above, the portion of the rubber tube 6 which is on the opposite side to the tube 12 is intended to remain in contact with the wall of the tube 3. To ensure this, this region of the rubber tube 6 may be bonded to the wall of the metal tube 3 or, preferably, as shown in FIG. 1, it may be mechanically clamped by means of a curved clamping plate 26 secured by a nut and bolt 27.

In a modification, the spring 14 is housed in a straight tube, indicated by broken lines 28 in FIG. 1, this tube 28 communicating with a shortened form of the tube 12. Some frictional clamping of the valve may then be necessary.

The apparatus shown in FIGS. 1 to 4 maybe used for example in propelling or assisting propulsion of a boat. For example, it may be powered by exhaust gas from a diesel engine forming the main propulsion unit for the boat. In such a case, the axis of the pipe 1 will be substantially horizontal.

The apparatus shown in FIGS. 1 to 4 may however also be used as a pump with the axis of the tube 1 either upright or inclined at a substantial angle to the horizontal. Possible uses for such a pump are as a bilge pump on a boat (again powered by exhaust gases from the driving engine of the boat) and as a pump for emptying flood water from manholes, grain-pits and the like where it will be noted that the pump is self priming and not particularly susceptible to damage by abrasive particles in the water.

Where a high lift is required, one or more booster devices may be inserted at appropriate points up the length of the pipe 1. One such booster device is shown in FIG. 5. The booster device shown in FIG. 5 comprises metal tubes 31 and 32 for insertion respectively in the pipes 1 and 9. The tube 32 is connected to the tube 31 by a cross tube 33. The lower portion of the pipe 1 has an enlarged mouth 34 to receive a cuff portion 35 of a rubber sleeve or tube 36, the cuff portion 35 being folded around the lower end of the tube 31 and securely clamped by means of a hose clip 37 around the upper end of the lower tube portion 1.

A tension spring 39 has one end secured to an anchor 40 which may be adjustable) in the side wall of the tube 32 and its other end to a second anchor 41 adjacent the lower end of an elongated stiff metal strip 42 which bears against the inner surface of the tube 36. The anchor 41 extends through both the strip 42 and the tube 36. On the opposite side to the strip 42, the tube 36 is secured to the tube 31, conveniently by means of a clamping strip 43 secured by bolts 34.

In operation, the tension of the spring 39 is chosen in relation to that of the spring 14 (FIG. 1) to ensure that the valve 19 opens at a pressure less than that required to move the spring anchorage 41. So long as liquid is propelled upwardly through the pipe 1 by the lower pumping apparatus, a spring 39 and strip 42 will ensure that the booster apparatus shown in FIG. 5 remains in the condition shown in that Figure. When, however, the liquid tries to move back downwards, the top right hand corner (as seen in FIG. 5) of the rubber tube 36 will be peeled away from the wall of the tube 31 towards the axis thereof. This action will be assisted if, as shown in the Figure, a tab 45 is bent inwards from the upper margin of the tube 31. The right hand portion of the tube 36 is then progressively peeled away from the right hand wall of the tube 31 thereby exerting on the anchorage 41 a force which, when added to the force exerted by the pressure of gases in the pipe 9, is sufficient to overcome the tension of the spring 39 and thus progressively deform the tube 36 in a similar manner to that in the case of FIGS. 1 to 4. Since any downward movement of liquid into the lower pipe 1 will result in closure of the foot valve formed by the rubber tube 6, the liquid will be impelled upwards through the upper pipe section.

In some cases it will be undesirable for the gases to mix with the liquid being pumped. For example, where it is desired to raise water for drinking purposes by means of the exhaust gases from an internal combustion engine such as a diesel engine or petrol engine, the apparatus shown in FIG. 6 may be used instead. This apparatus is a modified version of that shown in FIG. 1. In accordance with these modifications, the tube 6 is considerably lengthened and its downstream end is anchored and sealed to the downstream end of the extended tube 3.

For this purpose the downstream end of the rubber tube 6′ is folded outwards around the end of the tube 3′ and is clamped by the end of the pipe 1 and the hose clip 5.

One or more exhaust gas outlets 50 in the wall of the tube 3′ upstream of but adjacent its downstream end permit the escape of the spent and expanded gas. Appropriate non-return valves, such as resiliently flexible flaps 51 secured to the outer surface of the tube 3′ prevent liquid entering the interior of the tube 3′ around the tube 6′.

FIG. 7 shows a modification to the apparatus of FIGS. 1 to 4 which can also be applied to the apparatus of FIGS. 5 and 6.

In this modification, the gas is fed into the interior of the flexible tube 6″, the downstream end of which is secured to an exhaust outlet pipe leading out through the side of the tube 3″. This outlet tube 53 can be connected by a further pipe (not shown) extending above the surface of the liquid thereby ensuring that the gases are kept out of communication with the liquid.

The diameter or cross-sectional shape of the rubber tube 6″ may be smaller than the interior of the tube 3″ but capable of expansion by the gas pressure into contact with the tube 3″ so as to drive the liquid in the forward direction by a type of peristaltic action. At its inlet end of the tube 6″ may be somewhat flattened as shown and anchored to the inlet 4″ about only a small part of its periphery at 54.

FIG. 8 shows a modification of the apparatus shown in FIG. 6 which is again particularly suitable for pumping drinking water from a well. The rubber tube or sleeve 60 extends for the full length of the pipe 1 and is anchored to the top end of the latter, for example by being folded over the top end of the pipe 1 and anchored by a hose clip 61. Just below the top, the pipe 1 has a side outlet 62 for the spend gases to which a further pipe (not shown) can be connected to convey the gases for discharge at a point where there is no risk of contaminating the water.

Particularly where the pipe 1 is of some height, the performance of the pump apparatus can be improved by ensuring that the tube 60 remains in contact with the inner wall of the pipe 1 for as long as possible during a pumping stroke in which a change of gas travels up between the tube and the pipe, so as to keep the instantaneous portion 63 as short and as transverse as possible. This may be achieved by moulding sucker-like formations 64 (FIG. 9) on the side of the tube 60 oriented towards the gas inlet valve and the outlet 62, these formations being circumferentially continuously to prevent leakage of gas past them.

A similar result can be obtained by incorporating flexible arcuate circumferential stiffeners in the tube (as indicated diagrammatically at 65 in FIG. 8), these stiffeners being maintained in pre-compression by slight pre-stretching of the tube. Either way, the object is to increase lift without increasing the gas pressure.

In general, the best operation of the pumps described above is obtained by correct choice of the volume of the gas supply pipe and of the gas pressure.

In many applications, the gases will contain sufficient moisture to lubricate and cool the rubber tube. However, where hot dry gases are to be used, the gas inlet valve may be modified as shown in FIG. 10. The valve portion 19 of the tube carries a stainless steel washer 71 to seat on the end of the inlet tube 12. A spacer disc 72 may be added between the portion 19 of the tube 70 and the washer 71 further to protect the portion 19 from heat damage.

To ensure a cooling flow of water (even when the water level has dropped below the top of the mouth of the inlet), a small hole 73 is formed in the flexible tube or inlet end of the pipe and is closed by a rubber flap valve 74 as each charge of gas is released by the gas pulsing valve.

Alternatively, a clearance may be left between the shank of the rivet 17 and the rubber tube (or an eyelet lining the hole therein) and some axial movement of the washer 18 permitted to ensure ingress of a small amount of water.

In some cases, it may be necessary to replace the coil spring 14 within the curved end of the tube 12 by an external leaf spring to avoid overheating of the spring. Some frictional damping of the leaf spring may be required (as is obtained between the curved tube and the spring).

To prevent damage to the bottom end of the flexible tube in all the pumps described above by contact with the bottom of a well, it is preferred to mounting one or more short legs on the bottom end of the pipe 1.

FIG. 11 shows further modification in which non-return water valves are formed by the bottom and top ends of the rubber tube 80 the lower end 81 of which is folded inwards around the bottom end of a short tubular insert 82 in the pipe 1 to extend upwards at 83 for a length about equal to the tube diameter. An inclined elliptical grid 84 secures parts of the portion 83 and forms a seating for the remaining free, valve-forming portion 85. Corresponding parts of the upper valve portion are shown with the same reference numerals with the addition of the suffix a.

The gas inlet 86 opens into the side of the pipe 1, while opposite the outlet 62, the tube 80 is fixed to the wall of the pipe, for example by a rivet 87. Both the inlet 86 and the outlet 62 may be advantageously controlled by non-return flap valves.

Where a high lift is required, the intensifier arrangement shown in cross section in FIGS. 12 and 13 may be used, for example over the length L in FIG. 11. Over this length, the pipe 1 is replaced by one or more platen blocks 91 within a flexible envelope 92 of circumference which just allows the tube 80 to adopt its circular form. The admission of a pulse of gas into the envelope 92 causes the latter to adopt the shape shown in FIG. 13, driving liquid from the tube 80, the valves 85 and 85*a* ensuring that this takes place in the upward direction.

FIGS. 14 and 15 show two arrangements for taking only the initial high pressure portion in each exhaust pulse of a four stroke internal combustion engine, with a view to obtaining high lift without deleterious back pressure.

In the exhaust manifold 101 in FIG. 14, the gas supply for the pump is taken off through a side connection controlled by a light weight non-return valve 103. A restrictor 104 (which may be retractible when not required) downstream of the connection 102 diverts the initial pulse portions through the valve 103 but allows the lower pressure remainder to escape to the normal exhaust without substantial increased back pressure.

In practice the distance between the engine exhaust valve and the restriction should be brought to a minimum. Also the valve would be better facing the gas flow and thus its casing also acting as the restriction preferably right in the exhaust port of the cylinder-head.

Such an arrangement is shown in FIG. 15 where the light non-return valve 103A is mounted at the inlet end of a tube 105 inserted in an aperture 106 in the exhaust manifold 107 of a single cylinder engine (or the manifold branch of the cylinder of a multi-cylinder engine). The tube 105 may be slidably adjustable and tapered in the aperture and secured by a clamp 108.

In some cases a ball valve may be used, the ball turning through an angle at each operation to even out and reduce wear.

In the case of spark-ignition engines, for example 2-stroke engines a supply of gas may be obtained by mounting the spark plug in an adapter inserted in the spark plug hole of the engine, the adapter having a connection to the gas supply line for the pump, this connection preferably includes a construction, for example a ceramic material, possible with a screw-operated adjuster. A diabatic expansion of gases through the construction will cool them sufficiently to avoid heat damage to the pump.

When using a multicylinder spark ignition engine, the pump may be powered by compressed air generated by a commercially available (under the Trade Mark Schraeder) tire pump which is inserted in the spark plug hole of one of the cylinders.

Figure 16:
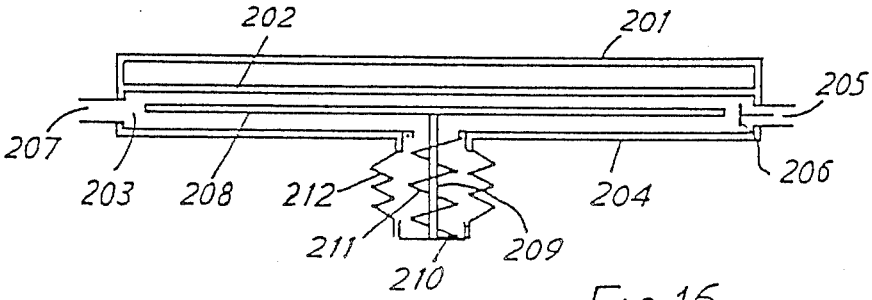

A solar-powered air compressor for powering any of the pumps shown in FIGS. 1 to 13 is shown in axial sectional in FIG. 16. The compressor is circular in plan and has a transparent cover disc 201, for example of glass. Space below the cover disc 201 is a blackened conductive metal plate 202 forming the top wall of an air compressing chamber 203, the bottom wall of which is formed by a further heat conductive plate 204 which is cooled, for example by liquid pumped by one of the pumps of FIGS. 1 to 13. The chamber 203 has an air inlet 205 controlled by an automatic air inlet valve 206 and an outlet 207 which is connected to the pump.

Between the plates 202 and 204 is an displacer disc 208 mounted on a central stem 209 terminating at its lower end in a spring retainer disc 210 supported by a spring 211 from the lower plate 204. A rubber bellows 212 extends between the lower plate 204 and the retainer plate 210. The working cycle of this compressor is as follows:

At rest, the displacer disc 208 rests lightly against the underside of the solar heated upper disc 202 and the air inlet valve 205 is likely closed. As the disc 208 is of slightly smaller diameter than the heated top disc B, some rise of the temperature of the air in the chamber 203 occurs. This causes the bellows 212 just to overcome the tension of the spring 209 so that the displacer disc 208 begins to move down from the upper disc 202. Air then flows between these two discs further increasing the pressure and now rapidly lowering the displacer disc 208 until it comes to rest on the cooled lower disc 204. All of the air within the chamber 203 flows around the edges of the disc to the upper face of the disc where it is heated in turbulent contact with the upper disc 202. Thus, a pulse of pressurised air is delivered to the pulsing valve of the pump through the outlet 207.

At the end of the pumping stroke, the pulsing valve 19 of the pump closes and the pressure within the chamber 207 has fallen to a value such that the spring 211 overcomes the force of the bellows 212 enabling the displacer disc 208 to rise again. The air remaining in the chamber 203 is cooled, contracts and draws in a further charge of air through the inlet 205, 206.

The air pipe connecting the outlet 207 to the water pump should be of as smaller volume as is convenient. This solar powered compressor effectively works as a stirling engine.

I claim:

1. Apparatus for cylically impelling liquid by means of gas under pressure, comprising a duct for the liquid, a flexible partition having a zone anchored with respect to said duct and extending from said anchored zone in the downstream direction of the duct, an opening in the wall of the duct for the supply of gas under pressure from a gas duct, the opening being adjacent, and on the downstream side of, the anchored zone of the partition, a valve member carried by, or formed by part of, the partition, and resilient spring means urging the valve member to close the opening until the pressure of gas accumulating, in use, in the gas duct is sufficient to overcome the resilient means and deliver through the opening a pulse of gas for causing the partition to impel liquid, said resilient spring means acting only on said valve member, said resilient spring means exerting a closing force on said valve member much greater than any closing force of which said flexible partition alone may be capable.

2. Apparatus according to claim 1, wherein the partition is capable of deformation between a position in which it substantially conforms to the duct wall and covers the said opening while leaving the duct substantially unobstructed, and a position in which the opening is uncovered so that gas, having attained sufficient pressure to overcome the resilient means, is directed downstream by the partition while the latter inflates across the duct.

3. Apparatus according to claim 1, wherein the duct is of substantially constant cross-section along its length and the partition is tubular and extends for substantially the whole length of the duct.

4. Apparatus according to claim 1, wherein the anchored zone of the partition extends around the full circumference of the duct at the inlet of the duct.

5. Apparatus according to claim 4, wherein the anchored zone of the partition is oblique with respect to the longitudinal axis of the duct, the partition having its portion adjacent the opening being furthest upstream.

6. Apparatus according to claim 1, wherein an openwork support structure is mounted with its periphery adjacent the anchored zone of the partition to act as a support for the partition against deformation beyond a predetermined configuration under gas pressure.

7. Apparatus according to claim 1, wherein free end portions of the partition form non-return flap valves.

8. Apparatus according to claim 1 having a solar heated compressor for supplying air under pressure to the opening, the compressor having a solar heated plate, a cooled plate, a displacer plate supported to be movable in a chamber between the two plates, and an air inlet and an air outlet for the chamber the air outlet being connected to said opening.

9. Pumping apparatus for liquid comprising an internal combustion engine having an exhaust duct, a duct for the liquid to be pumped, a tubular flexible partition having a zone anchored with respect to said duct and extending from said anchored zone in the downstream direction of the liquid duct, an opening zone in the wall of the liquid duct leading from the engine exhaust duct, the opening being adjacent, and on the downstream side of, the anchored region of the partition, a valve member carried by, or formed by part of, the partition, and resilient spring means urging the valve member to close the opening until the pressure of exhaust gas accumulating in the gas duct is sufficient to overcome the resilient means and deliver through the opening a pulse of gas for causing the partition to impel liquid, said resilient spring means acting only on said valve member, said resilient spring means exerting a closing force on said valve member much greater than any closing force of which said flexible partition alone may be capable.

10. Apparatus for cylically impelling liquid by means of gas under pressure, comprising a duct for the liquid, a flexible partition having a zone anchored with respect to said duct and extending from said anchored zone downstream along the duct, an opening in the wall of the liquid duct and a gas duct communicating with such opening for the supply of gas under pressure to said opening, the opening being adjacent, and on the downstream side of, the anchored zone of the partition, a valve member carried by, or formed by part of, the partition, and resilient means urging the valve member to close the opening until the pressure of gas accumulating in the gas duct is sufficient to overcome the resilient means and deliver through the opening a pulse of gas for causing the partition to impel liquid, the partition being capable of deformation between a first position in which it substantially conforms to the liquid duct wall and covers said opening while leaving the liquid duct substantially unobstructed, and a second position in which the opening is uncovered so that gas, having attained sufficient pressure to overcome said resilient means, is directed downstream by the partition while the partition inflates across the liquid duct, said liquid duct being of substantially constant cross-section along its length, such cross section being substantially circular, said partition being tubular and extending substantially the whole length of said duct, said anchored zone of said partition being oblique with respect to the longitudinal axis of said liquid duct, said partition being oriented with its portion adjacent said opening being the furthest upstream portion of said partition, an openwork support structure mounted with its periphery adjacent the anchor zone of the partition and acting as a support for the partition against deformation beyond a predetermined configuration under gas pressure, the partition having free end portions forming non-return flap valves, said gas duct extending through the wall of said liquid duct, said opening being defined by the end of said gas duct disposed within said liquid duct, said gas duct and said opening lying on an axis extending substantially perpendicular to the portion of said flexible partition anchored with respect to said liquid duct in opposed, adjacent relation to the end of said gas duct defining said opening, said resilient means defining a spring disposed internally of said gas duct, said spring being a tension spring fixed to the opposed portion of said flexible partition.

11. Apparatus for cylically impelling liquid by means of gas under pressure, comprising a duct for the liquid, a flexible partition having a zone anchored with respect to said duct and extending from said anchored zone in the downstream direction of the duct, an opening in the wall of the duct for the supply of gas under pressure from a gas duct, the opening being adjacent, and on the downstream side of, the anchored zone of the partition, a valve member carried by, or formed by part of, the partition, and resilient means disposed in said gas duct and urging the valve member to close the opening until the pressure of gas accumulating, in use, in the gas duct is sufficient to overcome the resilient means and deliver through the opening a pulse of gas for causing the partition to impel liquid.

* * * * *

UNITED STATES PATENT AND TRADEMARK OFFICE

CERTIFICATE OF CORRECTION

PATENT NO. : 4 732 547

DATED : March 22, 1988

INVENTOR(S) : Peter A. SHELTON

It is certified that error appears in the above-identified patent and that said Letters Patent is hereby corrected as shown below:

Column 8, Line 24; after "chamber" insert ---,---.

Column 8, line 31; delete "zone".

Signed and Sealed this

Eleventh Day of October, 1988

*Attest:*

*Attesting Officer*

DONALD J. QUIGG

*Commissioner of Patents and Trademarks*